US010697457B2

(12) United States Patent
Van Campfort et al.

(10) Patent No.: US 10,697,457 B2
(45) Date of Patent: Jun. 30, 2020

(54) DEVICE FOR COMPRESSING AND EXPANDING A GAS AND METHOD FOR CONTROLLING THE PRESSURE IN TWO GRIDS OF A DIFFERENT NOMINAL PRESSURE LEVEL

(71) Applicant: ATLAS COPCO AIRPOWER, NAAMLOZE VENNOOTSCHAP, Wilrijk (BE)

(72) Inventors: Kris Van Campfort, Wilrijk (BE); Kristof Pascal Hubin, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 493 days.

(21) Appl. No.: 15/312,032

(22) PCT Filed: May 11, 2015

(86) PCT No.: PCT/BE2015/000022
§ 371 (c)(1),
(2) Date: Nov. 17, 2016

(87) PCT Pub. No.: WO2015/176143
PCT Pub. Date: Nov. 26, 2015

(65) Prior Publication Data

US 2017/0122320 A1 May 4, 2017

(30) Foreign Application Priority Data

May 19, 2014 (BE) ..... 2014/0377

(51) Int. Cl.
*F04C 28/04* (2006.01)
*F04C 29/04* (2006.01)
(Continued)

(52) U.S. Cl.
CPC ..... *F04C 28/04* (2013.01); *F01K 13/02* (2013.01); *F04C 18/16* (2013.01); *F04C 28/28* (2013.01);
(Continued)

(58) Field of Classification Search
CPC ..... F04C 28/04; F04C 18/16; F04C 29/0085; F04C 29/045; F04C 29/126; F04C 2240/30; F04C 2240/40; F01K 13/02
(Continued)

(56) References Cited

U.S. PATENT DOCUMENTS 3,936,239 A * 2/1976 Shaw ..... F04C 28/125 417/315
4,209,998 A 7/1980 Shaw
(Continued)

FOREIGN PATENT DOCUMENTS

CN 1517512 A 8/2004
EP 1443201 A2 8/2004
(Continued)

OTHER PUBLICATIONS

CN Office Action in related CN Application No. 201580033131.2, dated Aug. 2, 2017.
(Continued)

*Primary Examiner* — Dominick L Plakkoottam
*Assistant Examiner* — Connor J Tremarche
(74) *Attorney, Agent, or Firm* — Bacon & Thomas, PLLC

(57) ABSTRACT

A device for compressing and expanding gases, wherein the device comprises an apparatus that can be driven in two directions, whereby in one direction the apparatus operates to compress a gas and in the other direction the apparatus operates to expand a gas.

18 Claims, 2 Drawing Sheets

(51) Int. Cl.

| | |
|---|---|
| ***F04C 29/00*** | (2006.01) |
| ***F04C 29/12*** | (2006.01) |
| ***F04C 18/16*** | (2006.01) |
| ***F04C 28/28*** | (2006.01) |
| ***F01K 13/02*** | (2006.01) |

(52) U.S. Cl.
CPC ..... *F04C 29/0085* (2013.01); *F04C 29/045* (2013.01); *F04C 29/126* (2013.01); *F04C 2240/30* (2013.01); *F04C 2240/40* (2013.01); *F04C 2240/50* (2013.01)

(58) Field of Classification Search
USPC ..... 417/237
See application file for complete search history.

(56) References Cited

U.S. PATENT DOCUMENTS

| | | | | |
|---|---|---|---|---|
| 5,903,060 | A * | 5/1999 | Norton | F02G 5/02 237/8 D |
| 2004/0135436 | A1* | 7/2004 | Gilbreth | H02J 1/10 307/18 |
| 2004/0173379 | A1* | 9/2004 | Leppanen | E21B 7/022 175/57 |
| 2004/0184923 | A1 | 9/2004 | Iwanami et al. | |
| 2006/0073050 | A1* | 4/2006 | Iwanami | B60H 1/3223 418/3 |
| 2009/0217693 | A1* | 9/2009 | Kikuchi | F04D 25/04 62/402 |
| 2010/0276239 | A1* | 11/2010 | Wuerth | B60T 8/266 188/358 |
| 2011/0070032 | A1* | 3/2011 | Frazier | E02D 29/10 405/210 |
| 2011/0094212 | A1* | 4/2011 | Ast | F02C 1/02 60/327 |
| 2014/0096523 | A1* | 4/2014 | Coney | F01K 23/10 60/650 |

FOREIGN PATENT DOCUMENTS

| | | | |
|---|---|---|---|
| GB | 2482416 | A | 2/2012 |
| JP | 2004232492 | A | 8/2004 |
| JP | 2004232495 | A | 8/2004 |
| JP | 2013520630 | A | 6/2013 |
| WO | 2011104556 | A2 | 9/2011 |

OTHER PUBLICATIONS

JP Office Action in related JP Application No. 2016-568554, dated Jul. 2, 2018.
International Search Report (ISR) dated Oct. 2, 2015, for PCT/BE2015/000022.
Written Opinion dated Oct. 2, 2015, for PCT/BE2015/000022.
Written Opinion dated Feb. 11, 2016, for PCT/BE2015/000022.

* cited by examiner

DEVICE FOR COMPRESSING AND EXPANDING A GAS AND METHOD FOR CONTROLLING THE PRESSURE IN TWO GRIDS OF A DIFFERENT NOMINAL PRESSURE LEVEL

The present invention relates to a device for compressing and expanding gases and a method for controlling the pressure in two networks with a different nominal pressure level.

BACKGROUND OF THE INVENTION

It is known that in industrial environments a gas network is used with coupled networks at different pressures. The gas can be steam for example, but also compressed air, natural gas, nitrogen or another type of gas.

The pressure in a network is obtained through a balance between gas supply and gas consumption, which in turn is controlled by either compressing gas from a certain pressure to a higher pressure, by a 'compression station', or by expanding gas from a certain pressure to a lower pressure, by an 'expansion station'. This expansion station can be a simple pressure reducing valve or an expander that converts the pressure difference into mechanical and/or electrical energy.

However, the known devices or machines only enable the gas to be processed in one direction: from high pressure to low pressure in pressure reducing valves and expanders or from low pressure to high pressure in compressors.

This has the disadvantage in the case of an expansion station that low pressure gas cannot be compressed to high pressure gas in the reverse direction, for example to flexibly respond to an increased gas demand in the high pressure network. Also a compression station cannot be used as an expansion station or flexibly respond to an increased demand in the low pressure network.

Traditionally gas networks with separate compression stations and separate expansion stations have the disadvantage that they cannot easily be deployed for energy storage.

As is known electrical energy cannot be stored directly, and it would be advantageous in times of a surplus of electrical energy if this could be used for compressing gas and using the gas network as an energy storage volume, and later expanding it back via an expander to generate electricity.

However, the traditional devices are unidirectional with regard to operation and cannot be used for this purpose.

It is then also often necessary to install two or more machines in the station, i.e. at least one expander and at least one compressor.

This has the disadvantage that the entire installation and control thereof becomes more complex and expensive.

SUMMARY OF THE INVENTION

The purpose of the present invention is to provide a solution to at least one of the aforementioned and other disadvantages.

The object of the present invention is a device for compressing and expanding gases, whereby the device comprises an apparatus that can be driven in two directions, whereby in one direction the apparatus operates to compress a gas and in the other direction the apparatus operates to expand a gas.

An advantage is that such a device operates in two directions, which means that a device according to the invention can both expand and compress gas.

As a result it is possible to supply two networks at a different pressure using one machine and thus to be able to respond much more flexibly to the requirements of different networks.

An advantage is that in this way the gas network can be used as an energy storage volume, depending on whether there is a surplus or demand for electrical energy, by using the station as a compression station or expansion station respectively.

This has the additional advantage that costs can be saved.

Moreover the entire installation will be simpler. The control thereof is also simpler because no interaction is possible between a separate compressor and expander.

Preferably energy can be recovered from the gas by the device when the apparatus operates for the expansion of a gas.

This is analogous to a traditional expander and has the advantage that there is less energy loss.

The invention also concerns a method for controlling the pressure in networks with a different nominal pressure level, respectively a high pressure network and a low pressure network, characterised in that both pressure networks are connected together by an apparatus that can act as both a compressor for compressing gas from the low pressure network to the high pressure network, and can act as an expander for expanding gas from the high pressure network to the low pressure network, whereby the method consists of controlling the apparatus as a compressor or expander on the basis of the pressure in the high pressure network and/or low pressure network.

Such a method has the advantage that it is much simpler than the method whereby use is made of a separate compressor and separate expander, for example because no interaction is possible between a separate compressor and expander.

The advantages are analogous to the advantages mentioned above of a device according to the invention.

BRIEF DESCRIPTION OF THE DRAWINGS

With the intention of better showing the characteristics of the invention, a few preferred variants of a device according to the invention and a method thereby applied are described hereinafter by way of an example, without any limiting nature, with reference to the accompanying drawings, wherein.

DETAILED DESCRIPTION OF THE INVENTION

Figure 1:
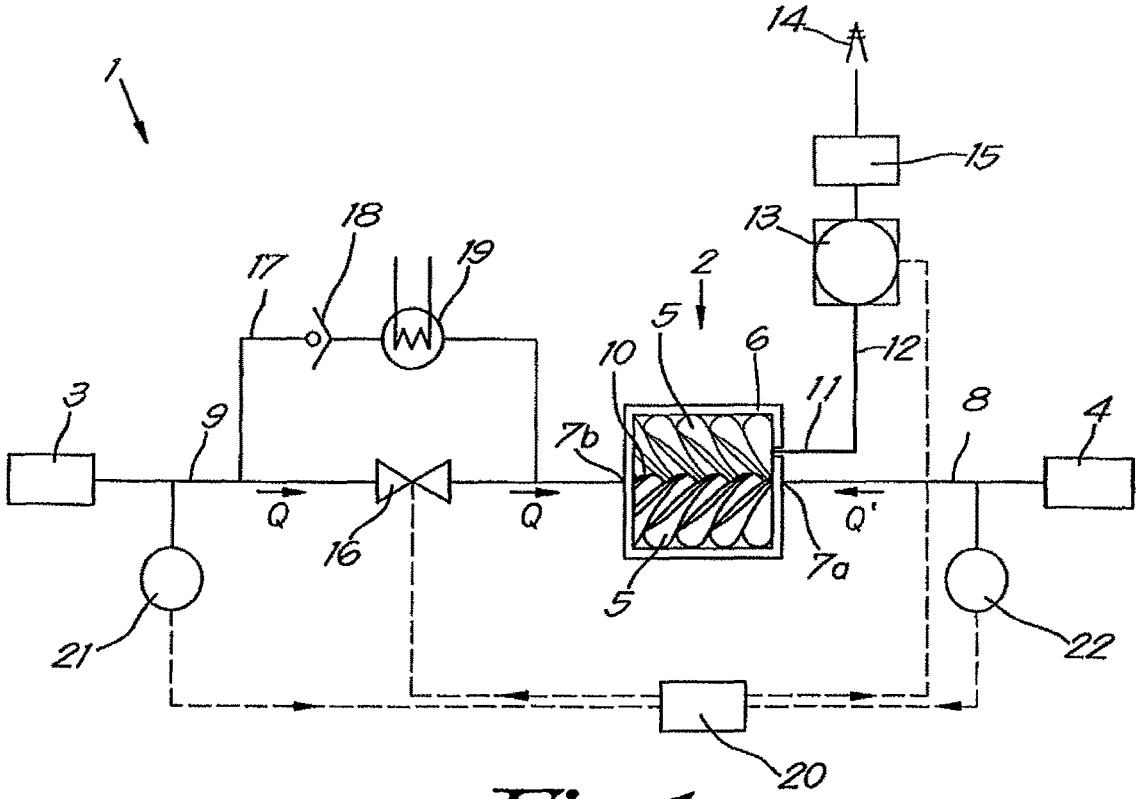
FIG. 1 schematically shows a device according to the invention.

The device 1 shown in FIG. 1 essentially comprises an apparatus 2 that can be driven in two directions, whereby in one direction it acts as a compressor for compressing gas and in the other direction as an expander for expanding gas.

In this case the apparatus 2 provides the link between a high pressure network 3 with air at a pressure of 16 bar for example, and a low pressure network 4 with air at a pressure of 4 bar for example.

In this case, but not necessarily, this apparatus is an adapted screw expander-compressor with two meshed screws 5 that are mounted on bearings in a housing 6 that is provided with two passages 7*a*, 7*b*.

The first passage 7*a* is connected to the low pressure network 4 via a low pressure pipe 8 and the second passage 7*b* is connected to the high pressure network 3 via a high pressure pipe 9.

By rotating the screws 10 in the one direction or in the other direction, the screw expander-compressor 2 will be able to compress gas from the first passage 7*a* to the second passage 7*b*, or can expand gas from the second passage 7*b* to the first passage 7*a*.

In other words the first passage 7*a* acts as the inlet when the apparatus 2 is driven as a compressor and as an outlet when the apparatus 2 is driven as an expander.

The second passage 7*b* acts as an outlet when the apparatus 2 is driven as a compressor and as an inlet when the apparatus 2 is driven as an expander.

The lobes of the screws 5 mesh together, and together with the housing 6 define a gastight chamber 10 that, when rotating the screws 5 in the one direction or in the other direction, moves from the first passage 7*a* to the second passage 7*b* or vice versa, and thereby becomes increasingly smaller or larger respectively, so that the gas trapped in this gastight chamber 10 can be compressed or expanded respectively.

Preferably the apparatus 2 is provided with the necessary bidirectional seals that ensure the necessary sealing in both directions in which the apparatus 2 can be driven. The bearings used, for example for the bearing of the screws 5 in the housing, also enable a rotation in both directions in which the apparatus 2 can be driven.

These measures will ensure that the apparatus 2 can operate in two directions without large losses due to poor seals or friction losses in bearings.

One of the two screws 5 is affixed on an outgoing shaft 11 that extends through the housing 6 to the outside, and which in this case is coupled to the shaft 12 of a motor 13, in this case an induction motor 13.

The motor 13 can be used to drive the apparatus when it operates as a compressor for compressing air.

The motor 13 is also used as a generator when the apparatus 2 operates as an expander to convert the mechanical energy on the outgoing shaft 11 into electrical energy.

It is clear that instead of an induction motor 13, another type of motor can also be used, provided that the motor can also act as a generator when energy is to be recovered.

The motor 13 is connected to the electricity network 14 via a four quadrant converter 15 that can draw energy from the electricity network 14, and supply energy that is recovered by the device 1 to the electricity network 14.

In this case, an inlet valve 16 is affixed in the high pressure pipe 9 to control the supply of gas from the high pressure network 3 to the low pressure network 4 via the apparatus 2.

In parallel to the inlet valve 16, in a bypass pipe 17 as it were, a non-return valve 18 is provided that only allows a gas flow from the low pressure network 4 to the high pressure network 3. This means that only when the apparatus is operating as a compressor can gas flow through the non-return valve 18.

In this case a heat exchanger 19 is placed in series with the non-return valve 18 for cooling the gas compressed by the apparatus 2.

The device 1 is further provided with a control unit 20 for controlling the device 1, more specifically the motor 13 and the inlet valve 16 for controlling the pressure in the high pressure network 3 and the low pressure network 4.

The control unit 20 is also coupled by means 21, 22 to determine the pressure in the high pressure network 3 and the low pressure network 4.

In this case, these means 21, 22 are constructed as pressure sensors that send their signal to the control unit 20.

The operation of the device 1 is very simple and as follows.

The apparatus 2 of the device 1 can either be driven as an expander or a compressor.

When the apparatus 2 is driven as an expander, the control unit 20 will control the inlet valve 16 such that a gas flow Q with a pressure of approximately 16 bar will be allowed through the apparatus 2 from the high pressure network 3. The non-return valve 18 will not allow any gas flow from the high pressure network 3 to the apparatus 2.

The gas flow Q will be expanded to a pressure of 4 bar by the apparatus 2, by which the screws 5 come into operation whereby the gastight chamber 10 moves from the second passage 7*b* to the first passage 7*a* and thereby becomes increasingly larger. In this way the gas flow Q will be supplied at a lower pressure of 4 bar to the low pressure network 4.

One of the two screws 5 will drive the outgoing shaft 11 such that the induction motor 13, which in this case is driven as a generator by the outgoing shaft 11, will produce power or thus electrical energy.

The recovered energy in the form of electric power will be supplied to the electricity network 14 by means of the four quadrant converter 15.

When the apparatus 2 is driven as a compressor, the controller 20 will drive the induction motor 13 so that the outgoing shaft 11 of the screw 5 is driven in the other direction, such that the apparatus 2 operates as a compressor. Hereby the induction motor 13 will draw energy from the electricity network 14 via the four quadrant converter 15.

A gas flow Q' will be compressed from the low pressure network 4 by the apparatus 2 to a pressure of 16 bar whereby in this case the gastight chamber 10 moves from the first passage 7*a* to the second passage 7*b* and thereby becomes increasingly smaller. It is also possible that the gas flow Q' is compressed to a pressure that is somewhat higher than 16 bar to take account of pipe losses for example that can occur, among others, in the heat exchanger 19.

As is known the temperature of the gas will increase during compression.

When the compressed gas leaves the apparatus at a higher pressure of 16 bar, it will be supplied to the high pressure network 3 via the non-return valve 18, whereby the inlet valve 16 is fully closed by the control unit 20.

Before the gas passes through the non-return valve 18, it will pass via the heat exchanger 19 in order to cool the gas after compression.

It is clear that the inlet valve 16 and the non-return valve 18 will ensure that the expander operation and the compressor operation of the device proceed well, whereby the inlet valve 16 will ensure a good control of the incoming gas flow during expander operation and whereby the non-return valve 18 will guarantee an unhindered flow of the compressed gas to the high pressure network 3.

Irrespective of the direction in which the apparatus 2 is driven, the seals and the bearings will ensure sufficient sealing in each direction and the lowest possible friction losses.

The control unit 20 will determine the direction in which the apparatus 2 must be driven, either as an expander or as a compressor, whereby use will be made of a method according to the invention for controlling the pressure of the two separate networks 3 and 4.

To this end the control unit 20 comprises an algorithm for controlling the apparatus 2 on the basis of the pressure in the high pressure network 3 and the low pressure network 4 that implements the steps of the method.

In a first step the pressure in the high pressure network 3 and the low pressure network 4 will be determined by the means 21 and 22.

On the basis of these pressures one of the following steps will be taken:

- when the pressure in the high pressure network 3 is lower than a set value $P_{HA}$, controlling the apparatus as a compressor;
- when the pressure in the low pressure network 4 is lower than a set value $P_{LA}$, controlling the apparatus 2 as an expander;
- when the pressure in both the low pressure network 4 and the high pressure network 3 is lower than the set values $P_{LA}$ and $P_{HA}$, switching off the apparatus 2;
- when the pressure in both the low pressure network 4 and the high pressure network 3 is higher than the set values $P_{LA}$ and $P_{HA}$, controlling the apparatus 2 as an expander or compressor according to choice.

Figure 3:
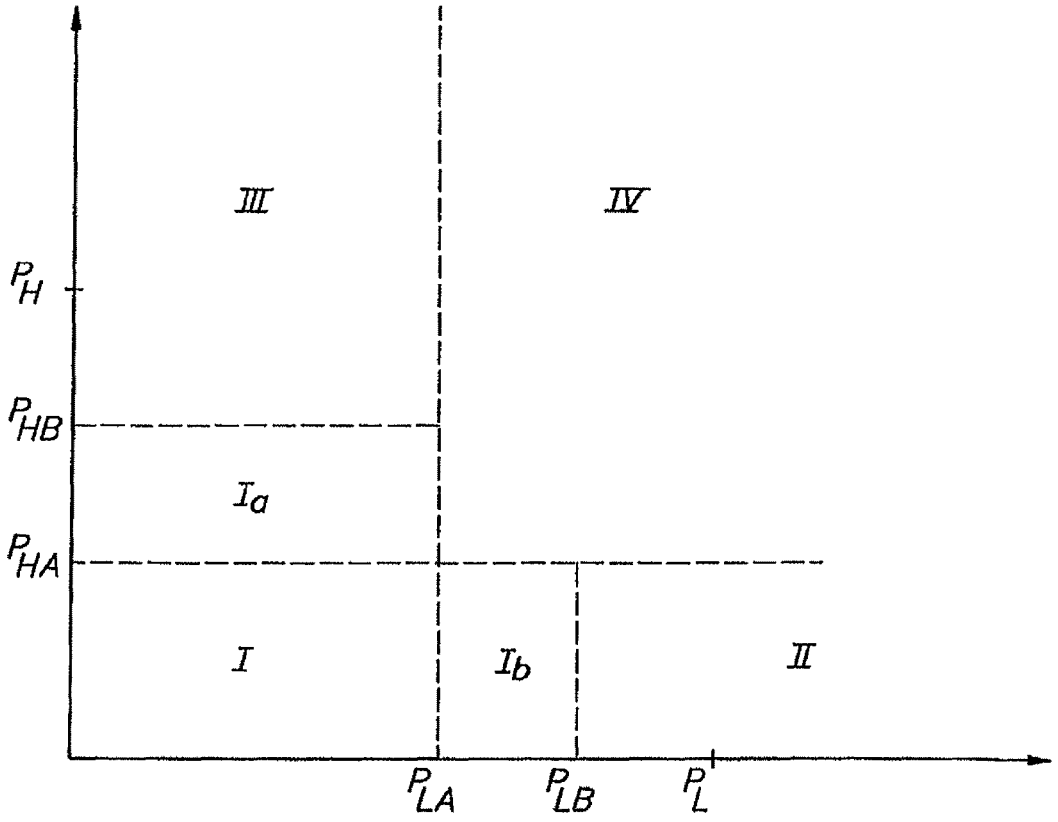
FIG. 3 schematically shows a method according to the invention.

This is schematically shown in FIG. 3. In the graph the horizontal axis indicates the pressure in the low pressure network 4, whereby $P_L$ is the target value or the nominal pressure level of the low pressure network 4 and is equal to 4 bar. The vertical axis indicates the pressure in the high pressure network 3 with a target value or nominal pressure level $P_H$ of 16 bar.

Four zones I to IV can be identified in the graph. In zone I the pressure in the low pressure network 4 and high pressure network 3 is lower than a set value $P_{LA}$ and $P_{HA}$, whereby these set values $P_{LA}$ and $P_{HA}$ are preferably 0.2 bar below the target values $P_L$ and $P_H$.

In this zone the control unit 20 will switch off the apparatus 2, such that no gas flow Q or Q' is possible between the networks 3 and 4.

In zone IV the pressure in both networks 3 and 4 is higher than the respective set value $P_{HA}$ or $P_{LA}$. The control unit 20 will be able to control the apparatus 2 either as a compressor or expander.

It could be chosen for example to determine the demanded or desired power or electrical energy for the electricity network 14, and on the basis of this demand to control the apparatus 2 as a compressor or expander. In this way it can respond to the demand for power of any electricity consumers that are connected to the electricity network 14.

Alternatively it can be chosen to control the apparatus 2 as a compressor when the difference between the set value $P_{LA}$ and the pressure in the low pressure network 4 is greater than the difference between the set value $P_{HA}$ and pressure in the high pressure network 3, and to control the apparatus 2 as an expander when the difference between the set value $P_{LA}$ and the pressure in the low pressure network 4 is less than the difference between the set $P_{HA}$ and the pressure in the high pressure network 3.

Without limiting the invention, a few other possibilities of a possible control in zone IV are given hereinafter.

- A pressure control of the high pressure network 3 whereby the control unit 20 will control the apparatus 2 so that the target value $p_H$ is maintained at all times. In the event of a large demand for high pressure gas, the apparatus 2 will operate as a compressor, and compress gas from the low pressure network 4 to the high pressure network 3. If the demand for high pressure gas falls, then in the first instance the apparatus 2 will slow down so that the gas flow Q' decreases. If the demand falls further, the apparatus 2 will stop and then start to operate as an expander to expand gas from the high pressure network 3 to the low pressure network 4 so that the pressure in the high pressure network 3 is maintained at the target value $p_H$.
- A pressure control of the low pressure network 4, whereby the control unit 20 will control the apparatus 2 so that the target value $p_L$ is maintained at all times by the application of a control that is analogous to the principle described above.
- Maximising the energy production, whereby the control unit 20 will control the apparatus 2 such that the apparatus 2 produces as much energy as possible. This means that the apparatus 2 will be driven as an expander at all times and preferably at a speed whereby the energy yield is a maximum. Such a control will be maintained for as long as the pressure in both networks 3 and 4 is higher than the respective set value $P_{HA}$ or $P_{LA}$.
- Maximising the energy consumption, whereby the control unit 20 will control the apparatus 2 such that the apparatus 2 consumes as much energy as possible. This means that the apparatus 2 will be driven as a compressor at all times and preferably at a speed whereby the energy consumption is a maximum. Such a control will be maintained for as long as the pressure in both networks 3 and 4 is higher than the respective set value $P_{HA}$ or $P_{LA}$.

When the pressure in the high pressure network 3 is lower than the set value $P_{HA}$ and the pressure in the low pressure network 4 is higher than $P_{LA}$, the control unit 20 will control the apparatus 2 as a compressor in order to supply the high pressure network 3 in this way with gas originating from the low pressure network 4. This corresponds to zone II in the graph of FIG. 3.

In this case the apparatus 2 will only be controlled as a compressor at when the condition is also satisfied that the pressure in the low pressure network 4 is higher than a preset value $P_{LB}$ that is higher than $P_{LA}$. In other words, in the zone $I_b$ the apparatus 2 will not operate as a compressor, but will be switched off for example.

When the pressure in the low pressure network 4 is lower than the set value $P_{LA}$, and the pressure in the high pressure network 3 is higher than $P_{HA}$, the control unit 20 will control the apparatus 2 as an expander to supply the low pressure network 4 in this way with gas originating from the high pressure network 3. This corresponds to zone III in the graph of FIG. 3.

In this case the apparatus 2 will only be controlled as an expander when the condition is also satisfied that the pressure in the high pressure network 3 is higher than a preset value $P_{HB}$ that is higher than $P_{HA}$. In other words, in the zone $I_a$ the apparatus 2 will not operate as an expander, but is switched off for example.

The aforementioned preset values $P_{LB}$ and $P_{HB}$ are preferably 0.1 bar below the target values $P_H$ and $P_L$.

By making use of the set values it can be ensured that the one network will only supply the other network when the one network itself has a sufficiently high pressure in order to prevent the one network being at too low a pressure due to the operation of the apparatus 2 or the apparatus 2 being repeatedly switched on and off.

It is clear that the set values $P_{LA}$, $P_{HA}$ and preset values $P_{LB}$, $P_{HB}$ stated above are only an example. It is possible for example to choose the values $P_{LB}$ or $P_{HB}$ to be equal to or even greater than the target values $P_L$ or $P_H$.

Figure 2:
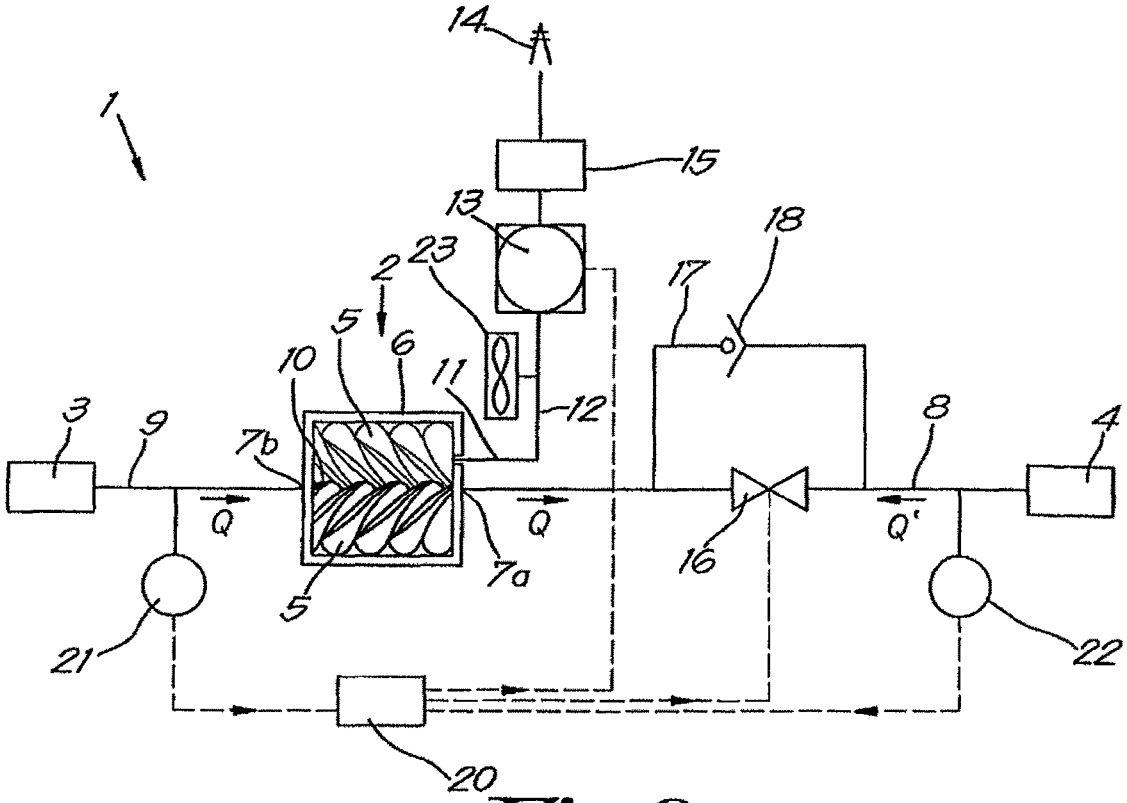
FIG. 2 shows an alternative embodiment of FIG. 1.

FIG. 2 shows an alternative embodiment of a device 1 according to the invention. In this case a cooling fan 23 is provided at the location of the shaft 12 of the motor 13 for cooling this shaft 12 in both directions in which the apparatus 2 can be driven.

Furthermore the inlet valve 16 is provided in the low pressure pipe 8, and in parallel to this inlet valve 16 only a non-return valve 18 is provided but not a heat exchanger 19.

For the rest the device 1 is identical to the device 1 shown in FIG. 1.

A third possible variant would consist of moving the heat exchanger 19 in FIG. 1 to the high pressure pipe 9, just next to the apparatus 2 at the side of the high pressure network 3. In the arrangement of FIG. 1 this means that the heat exchanger 19 will then be placed to the left of the apparatus 2.

The heat exchanger 19 can be used for cooling the gas after the compression if the apparatus 2 operates as a compressor, but just as well as preheating if the apparatus 2 operates as an expander.

Although in the examples shown, the inlet valve 16 and the non-return valve 18 are constructed separately, it is not excluded that these two valves 16 and 18 are affixed in one housing or that one specially controlled valve is used that combines the functionalities of these two valves 16 and 18.

The present invention is by no means limited to the embodiments described as an example and shown in the drawings, but such a device and method can be realised in different variants without departing from the scope of the invention.

The invention claimed is:

1. A device for compressing and expanding gases, the device comprises:

an apparatus that is configured to be driven in two directions, wherein in a first direction, the apparatus operates to compress a gas and in a second direction, the apparatus operates to expand a gas;

a high pressure pipe that connects the apparatus to a high pressure supply network and a low pressure pipe that connects the apparatus to a low pressure supply network; and a control unit for controlling the device in order to control a supply of gas to control pressure in the high pressure supply network and/or the low pressure supply network, wherein the apparatus, when it is driven in the first direction, is configured to compress the gas from the low pressure supply network to the high pressure supply network, and when the apparatus is driven in the second direction, the apparatus is configured to expand the gas from the high pressure supply network to the low pressure supply network, wherein in the high pressure pipe or in the low pressure pipe an inlet valve is affixed for controlling the supply of the gas from the high pressure supply network to the low pressure supply network via the apparatus, wherein a non-return valve is provided in parallel to said inlet valve, wherein said non-return valve allows a gas flow from the low pressure pipe to the high pressure pipe, wherein the device is provided with means to determine the pressure in the high pressure supply network and low pressure supply network, and wherein the control unit contains an algorithm for driving the apparatus in the first or second directions on a basis of the pressure determined in the high pressure supply network and low pressure supply network based on at least one of the following:

when the pressure in the high pressure supply network is lower than a set value for the high pressure network, controlling the apparatus as a compressor;

when the pressure in the low pressure supply network is lower than a set value for the low pressure network, controlling the apparatus as an expander;

when the pressure in both the low pressure supply network and the high pressure supply network is lower than the set values, switching off the apparatus; and when the pressure in both the low pressure supply network and the high pressure supply network is higher than the set values, controlling the apparatus as an expander or compressor according to choice.

2. The device according to claim 1, wherein when the apparatus operates for expanding the gas, energy is able to be recovered from the gas by the device.

3. The device according to claim 2, wherein the device is provided with a motor with a shaft that is connected to the apparatus, wherein the motor is configured to act as a motor to drive the apparatus when the apparatus operates to compress the gas and wherein the motor is configured to also act as a generator for the recovery of energy from the gas when the apparatus operates to expand the gas.

4. The device according to claim 3, wherein the motor is an induction motor.

5. The device according to claim 3, wherein the device is provided with a cooling fan for cooling the shaft of the motor in both directions in which the apparatus can be driven.

6. The device according to claim 2, wherein the device is provided with a four quadrant converter that can supply the energy, recovered by the device, to an electricity network when the apparatus operates to expand the gas and which can draw energy from the electricity network to drive the apparatus when it operates to compress the gas.

7. The device according to claim 1, wherein the apparatus is an adapted screw expander-compressor with two meshed screws that are mounted on bearings in a housing that is provided with two passages, of which the first passage can act as an inlet or an outlet depending on whether the apparatus is driven in the first direction for compressing gas or in the second direction for expanding gas, while the second passage can act as an outlet or inlet depending on whether the apparatus is driven in the first direction for compressing gas or in the second direction for expanding gas.

8. The device according to claim 1, wherein the apparatus is provided with at least one bidirectional seal that ensures sealing in both directions in which the apparatus is driven.

9. The device according to claim 1, wherein the apparatus is provided with bearings that enable a rotation in both directions in which the apparatus can be driven.

10. The device according to claim 1, wherein the inlet valve and the non-return valve are affixed in one housing.

11. The device according to claim 1, wherein a heat exchanger is placed in series with the non-return valve for cooling the gas compressed by the apparatus.

12. The device according to claim 1, wherein the device is provided with a heat exchanger in the high pressure pipe next to the apparatus on the side of the high pressure supply network.

13. The method for controlling the pressure in multiple networks, wherein use is made of the device according to claim 1.

14. The device according to claim 1, wherein the choice is chosen from at least one of the following: demand or desired power or electrical energy for an electricity network; difference between the set value in the low pressure supply network and the pressure in the low pressure supply network is greater than a difference between the set value in the high pressure supply network and the pressure in the high pressure supply network; maintain a target value of the high pressure supply network; maintain a target value of the low pressure supply network; maximize energy production; and maximize energy consumption.

15. The device according to claim 1, wherein the controlling is based in part on a set value for the high pressure supply network, and a set value for the low pressure supply network.

16. A method for controlling a pressure in two supply networks each having a different nominal pressure level, respectively a high pressure supply network and a low pressure supply network, wherein both pressure supply networks are connected together by an apparatus that is configured to act as both a compressor for compressing the gas from the low pressure supply network to the high pressure supply network, and is configured to act as an expander for expanding the gas from the high pressure supply network to the low pressure supply network, the method comprising the steps of:

determining the pressure in the high pressure supply network and low pressure supply network, controlling the apparatus as a compressor or expander on the basis of the pressure in the high pressure supply network and/or low pressure supply network, wherein the apparatus is driven in a first or second direction on a basis of the pressure determined in the high pressure supply network and low pressure supply network based on at least one of the following:

when the pressure in the high pressure supply network is lower than a set value for the high pressure network, controlling the apparatus as a compressor;

when the pressure in the low pressure supply network is lower than a set value for the low pressure network, controlling the apparatus as an expander;

when the pressure in both the low pressure supply network and the high pressure supply network is lower than the set values, switching off the apparatus; and when the pressure in both the low pressure supply network and the high pressure supply network is higher than the set values, controlling the apparatus as an expander or compressor according to choice.

17. The method according to claim 16, wherein only if the pressure in the low pressure supply network is higher than a preset value can the apparatus be controlled as a compressor and that only if the pressure in the high pressure supply network is higher than a preset value can the apparatus be controlled as an expander.

18. The method according to claim 16, wherein the set value is 0.2 bar below the target value of the high pressure supply network or low pressure supply network and/or that the preset value is 0.1 bar below the target value of the high pressure supply network or low pressure supply network.

* * * * *